United States Patent [19]

Ulatowski et al.

[11] 3,934,371

[45] Jan. 27, 1976

[54] FINGER GUARD FOR PIVOT HUNG DOOR

[75] Inventors: Henry J. Ulatowski, Southington; William H. Flaherty, Jr., Bristol, both of Conn.

[73] Assignee: The Stanley Works, New Britain, Conn.

[22] Filed: Apr. 7, 1975

[21] Appl. No.: 565,645

[52] U.S. Cl. ..... 49/383
[51] Int. Cl.[2] ..... E05D 11/00
[58] Field of Search ..... 49/383, 475

[56] References Cited

UNITED STATES PATENTS

| | | | |
|---|---|---|---|
| 2,184,259 | 12/1939 | Seaman | 49/383 |
| 2,694,234 | 11/1954 | Roby et al. | 49/383 |

FOREIGN PATENTS OR APPLICATIONS

| | | | |
|---|---|---|---|
| 778,626 | 7/1957 | United Kingdom | 49/383 |

*Primary Examiner*—Marion Parsons, Jr.
*Attorney, Agent, or Firm*—Prutzman, Hayes, Kalb & Chilton

[57] ABSTRACT

A finger guard assembly is structured for easy field retrofitting to a standard center-pivot door without removing the door from the doorway. The assembly includes a pair of extruded jamb guard members flush mounted on a doorway jamb and a pair of extruded door guard members flush mounted on the opposite parallel surfaces of the door stile. The jamb guard members and door guard members are shaped and positioned to cooperatively provide a narrow gap for preventing the entry of fingers therebetween. The several guard members are temporarily supported in position on the jamb and door by double faced adhesive tape preparatory to final mounting.

7 Claims, 3 Drawing Figures

FINGER GUARD FOR PIVOT HUNG DOOR

BRIEF SUMMARY OF THE INVENTION

The present invention relates to center-pivot hung doors and more particularly to a standard center-pivot hung door incorporating a finger guard assembly suited for field retrofit installation.

In conventional center-pivot hung doors, there is a danger of inadvertent pinching or crushing of fingers between the door stile and door jamb when the door is rotated from an open to a closed position. Efforts have been made in the past to devise special doors for preventing the insertion of fingers between the door stile and door jamb. One such door is described in U. S. Pat. No. 1,071,251 of Aug. 26, 1913. However, this patent requires the use of a door having a special stile construction and a doorway having a special jamb construction so that it is expensive and is not suited for field retrofit on existing doors.

Accordingly, it is the principal object of the present invention to provide a standard center pivot door incorporating an improved finger guard assembly. Included in this object is the provision of a finger guard assembly which may be field retrofitted on a center-pivot hung door without removing the door from the doorway.

Another object of this invention is to provide a finger guard assembly for standard center-pivot hung doors which is of low cost and may be kitted for field installation on a number of different conventional pivot hung door installations. Included in this object is the provision of paired extrusions which may be cut to varying lengths for application to such doors.

Still another object of the present invention is to provide a finger guard assembly of reinforced and durable construction.

A further object of the present invention is to provide a finger guard assembly adapted to be mounted on the door stile and the door jamb by fastening means which are easily installed and are concealed following installation.

An even further object of the present invention is to provide a method and means for pre-positioning and temporarily supporting the finger guard assembly preparatory to its final installation.

Other objects will be in part obvious and in part pointed out more in detail hereinafter.

A better understanding of the invention will be obtained from the following detailed description and the accompanying drawings which set forth an illustrative embodiment indicative of the way in which the principals of the invention are employed.

DESCRIPTION OF THE PREFERRED EMBODIMENT

Figure 1:
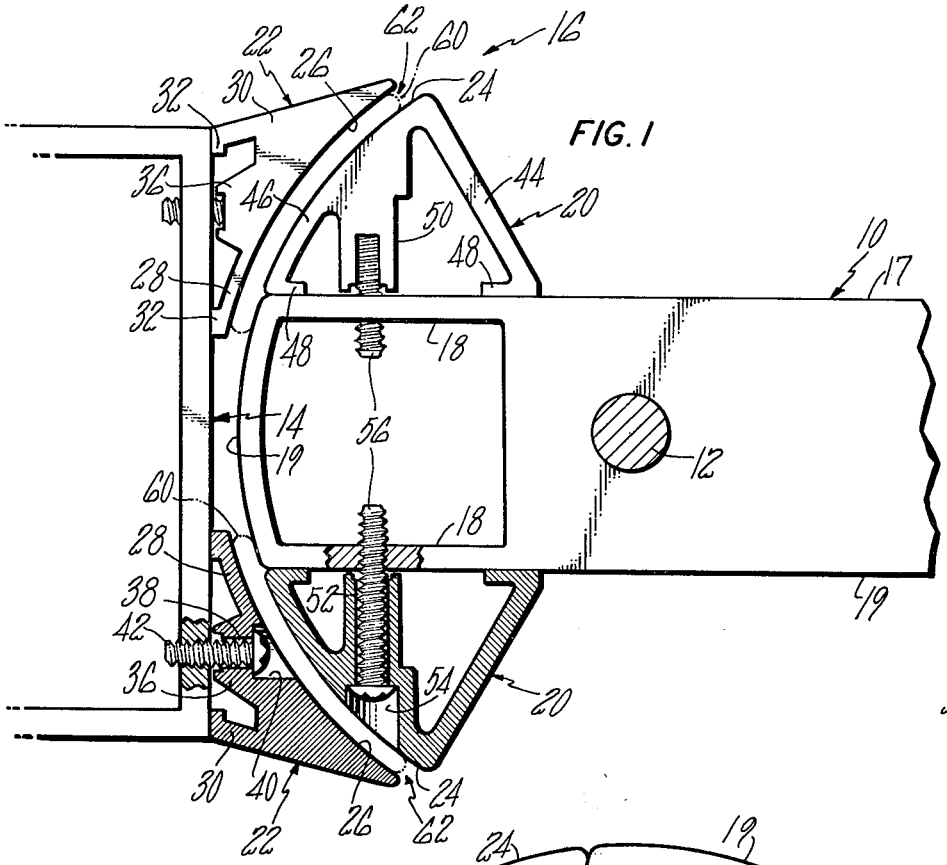
FIG. 1 is a partial top view of a conventional center-pivot hung door in the closed position showing the finger guard assembly of the invention, partly in section, mounted thereon.

Referring now to the drawings in detail wherein like reference numerals indicate like parts throughout the several figures, a standard center-pivot hung door 10 is shown in top view with its pivot 12 extending from the top of the door. A stile 18 has two parallel opposite sides which are shown as being flush with the opposite inside and outside faces 17 and 19 of the door 10. The door 10 is mounted within a frame or doorway, not shown, which includes a conventional flat jamb 14 as one vertically extending lateral boundary thereof. The pivot 12 mounts the door to the frame of the doorway in a conventional manner adjacent the jamb 14 for bi-swinging pivotal movement of the door 10 about the pivot. The door 10 may be opened either manually or through the use of a suitable power operator.

According to this invention, a finger guard assembly 16 is provided to prevent fingers from entering the space between the stile and the door jamb, particularly when the door is pivoted from an open to a closed position.

The finger guard assembly 16 essentially consists of a pair of door guard members, each numbered 20, affixed to the stile 18 of the door 10 and a pair of jamb guard members, each numbered 22, affixed to the jamb 14. Each door guard member 20 is a mirror image of the other, with both of identical shape and being inverted relative to the other. This same situation of symmetry and identical structure pertains to the two jamb guard members 22. The door guard members 20 and the jamb guard members 22 are preferably elongated, substantially rigid extrusions of aluminum or the like, one extrusion being cut to provide both door guard members and another extrusion being cut to provide the two jamb guard members. Each door guard member 20 is shown as having an exposed convex surface 24. Similarly, each jamb guard member 22 is shown as having an exposed convex surface 26 which is mounted in spaced, facing relationship with surface 24, as will be hereinafter more fully described.

Referring first to the two jamb guard members 22, each is cut to substantially the same length as the height of door jamb 14 and is generally V-shaped in transverse section as seen in FIG. 1. The jamb guards 22 are mounted on the jamb 14 such that its general V-shape is inverted relative to the surface of the jamb. One leg 28 of the jamb guard 22 is curved to provide the concave outwardly facing exposed surface 26. Both the leg 28 and the other leg 30 have enlarged support feet 32 at their free ends. The support feet 32 have flat surfaces for engagement with jamb 14. A strip of adhesive tape 34 may be interposed between the feet 32 and the jamb 14 for purposes hereinafter described.

The jamb guard members 22 are flush mounted on the flat jamb 14 in spaced relationship to and extend vertically parallel one another and as shown have their legs 30 respectively adjacent the outer edges of the jamb 14. The legs 28 which include the concave surface 26 extend inwardly toward the middle of the jamb 14. The radius of curvature of the concave surface 26 is preferably equal to the radial distance from the surface 26 to the axis of the pivot 12 when the guards 22 are mounted on the jamb 14.

A rib 36 extends longitudinally of each jamb guard member 22 between the legs 28, 30. More specifically, the rib 36 extends inwardly toward the jamb 14 from the leg 28. The rib 36 reinforces the jamb guard members 22 and further, includes several mounting apertures 38 therethrough (only one being shown here) spaced along its length. A counterbore 40, coaxial with each aperture 38, extends inwardly from the surface 26 a sufficient distance to permit the head of a fastener, such as a screw 42, to be recessed below the concave surface 26. The mounting aperture 38 and counterbore 40 are preformed subsequent to the extrusion of the member 22 and prior to its shipment to the field. Pilot holes are drilled into the jamb 14 for receiving screws 42, which may be of the self-tapping type. The screws 42 threadedly engage the jamb 14 to rigidly retain the jamb guards 22 in final fixed position on the jamb.

Each rib 36 is sized such that it is spaced slightly from the jamb 14, when the support feet 32 are in supported engagement with the jamb. This spacing permits the screws 42 to draw the feet 32 into firm engagement with the jamb 14.

The door guard members 20 are generally V-shaped in transverse section and include a straight leg 44 which extends inwardly toward the stile 18 at angle to the door 10 and a leg 46 which is curved outwardly to provide the convex surface 24. A pair of enlarged support feet 48 are provided at the free ends of legs 44 and 46 of each door guard member 20. The feet 48 extend toward one another from the legs 44, 46, along the door 10 in engagement with the surface of the stile 18. A door guard member 20 is positioned on each side of the stile 18 such that the convex surface 24 of the leg 46 substantially comprises an extension of the curved surface which forms the edge 19 of the door 10. The radius of curvature of the convex surface 24 is preferably formed to equal the distance from that surface when mounted to the axis of pivot 12 to maintain a constant gap with the concave surface 26 when the door is opened and closed.

Each door guard member 20 includes a rib 50 extending longitudinally thereof. The rib 50 extends inwardly from the leg 46 toward the door stile 18, and includes a plurality of longitudinally spaced preformed mounting apertures 52, which include counterbores 54. The ribs 50 are sized to be spaced slightly from the door 10 when the feet 48 are in engagement therewith in order to insure full surface contact between the feet and the door. Fasteners, such as self-tapping screws 56, extend through the apertures 52 and into threaded engagement with the door 10 for maintaining the door guard members 20 in fixed final positioning.

Figure 2:
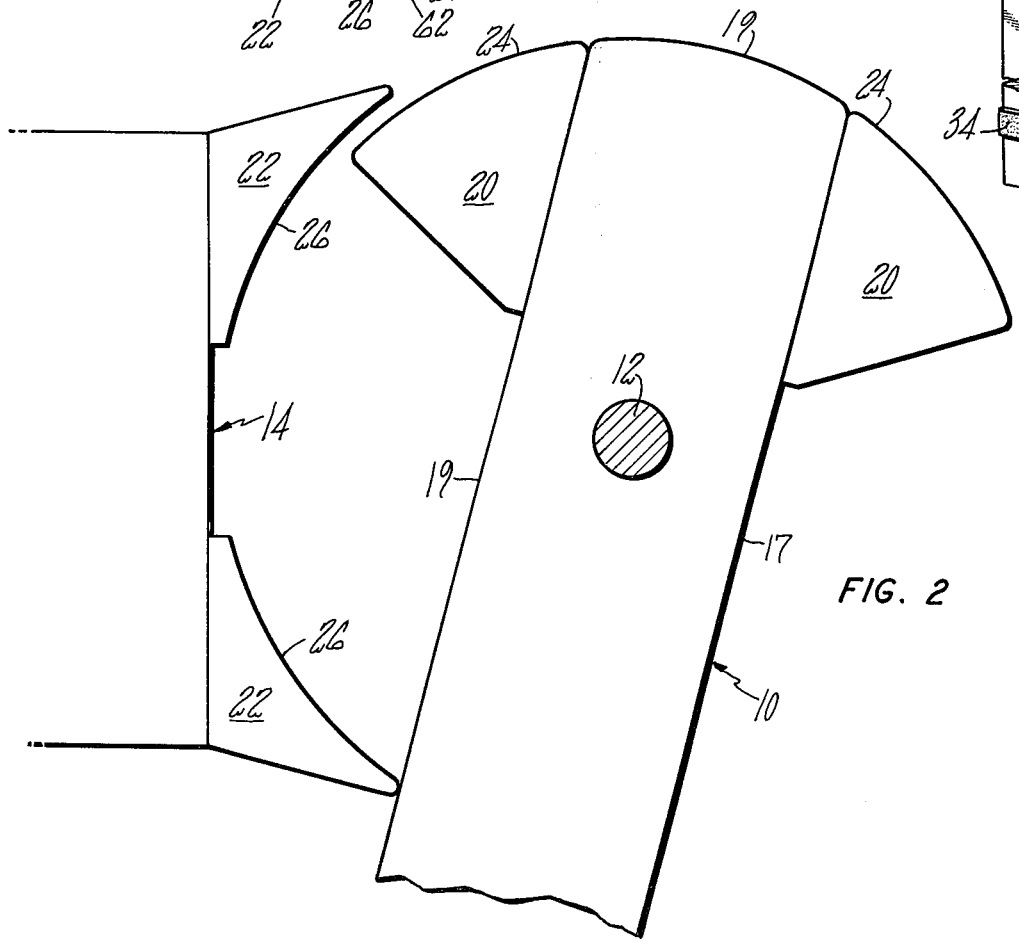
FIG. 2 is a view similar to that of FIG. 1 showing the door pivoted to a fully open position.

The combined angular extent of the curved surfaces 24 and 26 of the door guard member 20 and the jamb guard member 22 respectively are such that the jamb guard members 22 are maintained in overlapping relationship with the door guards 20 in all positions of the door about the pivot 12 as shown in FIG. 2 wherein the door 10 has been rotated about 115° from the closed position into the fully open position. As shown, the jamb guard members 22 serve to limit the movement of the door 10 in its open positions.

Figure 3:
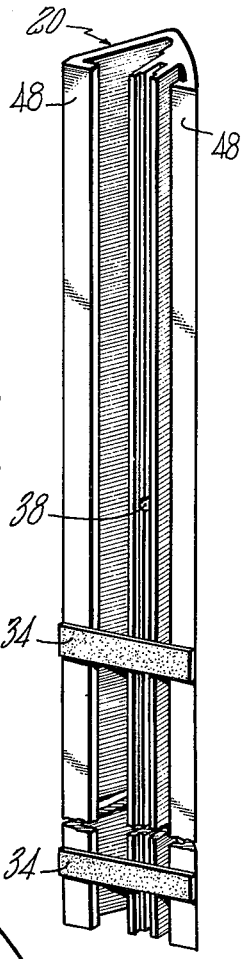
FIG. 3 is an isometric view of a representative one of the guard members which make up the finger guard assembly showing strips of adhesive tape affixed thereto.

In order to facilitate the retrofit mounting of the finger guard assembly 16 on the jamb 14 and door 10, strips of double-faced adhesive tape 34 may be affixed to each guard member of the assembly, as shown in FIG. 3, for temporarily maintaining it in adjusted position on the jamb 14 or the door 10 while a pilot hole is being drilled and screws 42 and 56 are inserted.

Typically, the jamb guard members 22 will be installed first on the jamb 14 and adjusted so that the gap 62 provides the desired clearance with the door edge 19. With the tape strips 34 serving to maintain each guard member temporarily in position on the jamb, pilot holes are drilled through the jamb, and the screws 42 are inserted to secure the jamb guard members 22 to the jamb 14. Subsequently, door guard member 44 will be positioned on opposite sides of the door 10 and adjusted so that the gap 62 between the facing surfaces 24 and 26 provide the desired clearance and temporarily supported thereby the tape 34 while pilot holes are drilled in opposite sides of the stile 18. The fastening screws 56 are then inserted through the mounting apertures 52 to fix the door guard members on the door 10. The door 10 must be opened sufficiently during the installation of each door guard member 44 to enable the pilot holes to be drilled and the screws 56 finally inserted.

The radial spacing between the surfaces 24 and 26 should be such that the narrow gap 62 at the outer end of the jamb guard members 22 is small enough to prevent fingers from becoming pinched therebetween but sufficient to insure free rotation of the door 10 on the pivot 12. This spacing might typically be one-eighth inch. In order to insure this spacing during installation, one or more spacing members, such as spacers 60 shown in phantom in FIG. 1, may temporarily be placed against the surface 26 of both of the jamb guard members 22 and initially against the door edge 19 preparatory to the installation of the jamb guard members and subsequently against the surfaces 24 of the door guard members 20 preparatory to their installation.

It will be appreciated that the width of gap 62 adjacent the outer end of each jamb guard member 22 extends uniformly across the full circumferential extent of the surface 26 because of the concave-convex parallellism of the members in the illustrated embodiment.

As will be apparent to persons skilled in the art, various modifications, adaptations and variations of the foregoing specific disclosure can be made without departing from the teachings of the present invention.

We claim:

1. A standard center-pivot door pivotally mounted adjacent a jamb having a stile with opposite parallel sides and a finger guard assembly suited for field retrofit assembly to the door and to the jamb, said finger guard assembly comprising a pair of elongated jamb guard members each having a supporting surface flush mounted on the surface of the jamb facing the doorway and in spaced parallel relationship with each other, each of said jamb guard member having an exposed surface extending along its length facing the axis of the door pivot, a pair of elongated door guard members each having a supporting surface flush mounted on said opposite parallel sides of said door stile, each said door guard member having a surface respectively facing one of said exposed surfaces of one of said jamb guard members, mounting means for mounting each of said jamb guard members and said door guard members on the jamb and door stile respectively to define a narrow gap therebetween along their lengths whereby the gap remains substantially the same dimension as the door swings from its full closed to a full open position.

2. The apparatus of claim 1 wherein each said door guard member surface in facing relation with each said jamb guard member exposed surface is convex and substantially lies in a circle about the axis of the door pivot which includes the edge of the door.

3. The apparatus of claim 2 wherein each said jamb guard member exposed surface is concave and substantially lies in a circle about the axis of the door pivot.

4. The apparatus of claim 1 including preformed mounting apertures through each of said jamb guard member exposed surfaces and each of said facing door guard member surfaces, and said mounting means comprise fastening means extending through said mounting apertures and into engagement with said jamb and said door stile respectively.

5. The apparatus of claim 4 wherein each said jamb guard member and door guard member includes a mounting rib extending from said exposed surface inwardly toward said jamb and from said facing surface inwardly toward said door respectively, each said preformed mounting aperture extending inwardly through a said mounting rib and including a counterbore at its outer end for receiving the head of said fastening means, and each said mounting rib being spaced, in relaxed condition, from the respective jamb and door surface to thereby insure close engagement respectively between said jamb guard supporting surface and said jamb and said door guard supporting surface and said door.

6. The apparatus of claim 3 wherein said jamb guard members and said door guard members are extrusions, each having an inverted substantially V-shape in transverse section, one leg of the V being curved to provide the respective said concave and convex surfaces, said door guard member and jamb guard member supporting surfaces comprising a foot at the base of each leg of the V, and said mounting ribs extend inwardly of the V from said concave and convex surfaces respectively.

7. The apparatus of claim 1 wherein said mounting means include temporary support means comprising at least one strip of bonding tape having adhesive on both sides thereof associated with each said jamb guard member and with each said door guard member, said tape being interposed respectively between each said jamb and between each said door guard member supporting surface and said door stile in oppositely connecting adherence with each for temporary supporting connection, and including fastening means for permanently connecting each said temporarily supported jamb guard member and door guard member to said jamb and said door stile respectively.

* * * * *